US007568950B2

(12) United States Patent
Belopolsky et al.

(10) Patent No.: US 7,568,950 B2
(45) Date of Patent: Aug. 4, 2009

(54) HIGH SPEED MODULAR JACK INCLUDING MULTIPLE CONTACT BLOCKS AND METHOD FOR ASSEMBLING SAME

(75) Inventors: Yakov Belopolsky, Harrisburg, PA (US); David Gutter, Felton, PA (US); Richard Marowsky, York, PA (US)

(73) Assignee: Bel Fuse Ltd., San Po Kong, Kowloon (HK)

( * ) Notice: Subject to any disclaimer, the term of this patent is extended or adjusted under 35 U.S.C. 154(b) by 0 days.

(21) Appl. No.: 11/748,674

(22) Filed: May 15, 2007

(65) Prior Publication Data

US 2007/0270034 A1 Nov. 22, 2007

Related U.S. Application Data

(60) Provisional application No. 60/747,534, filed on May 17, 2006.

(51) Int. Cl.
*H01R 13/648* (2006.01)

(52) U.S. Cl. ..... 439/607.55; 439/676

(58) Field of Classification Search ..... 439/607, 439/676

See application file for complete search history.

(56) References Cited

U.S. PATENT DOCUMENTS

| | | | | |
|---|---|---|---|---|
| 5,605,469 | A * | 2/1997 | Wellinsky et al. | 439/417 |
| 5,895,292 | A * | 4/1999 | Affeltranger | 439/610 |
| 6,077,122 | A * | 6/2000 | Elkhatib et al. | 439/608 |
| 6,080,018 | A * | 6/2000 | Ferrill et al. | 439/610 |
| 6,267,617 | B1 * | 7/2001 | Nozick | 439/417 |
| 6,682,368 | B2 * | 1/2004 | Murr et al. | 439/607 |
| 6,702,617 | B1 * | 3/2004 | Clement et al. | 439/608 |
| 6,739,892 | B1 | 5/2004 | Belopolsky et al. | |
| 6,780,054 | B2 * | 8/2004 | Yip et al. | 439/607 |
| 7,195,518 | B2 * | 3/2007 | Bert et al. | 439/608 |
| 2002/0016107 | A1 * | 2/2002 | Bellemon et al. | 439/638 |

* cited by examiner

*Primary Examiner*—Hae Moon Hyeon
(74) *Attorney, Agent, or Firm*—Cozen O'Connor

(57) ABSTRACT

A high speed jack capable of handling Category 7 communications. The jack comprises a shield and a housing inside the shield. The housing defines four distinct chambers for holding at least a first, second third, and fourth contact block, each contact block including at least two contacts. The contact blocks may be disposed symmetrically about a central axis of the housing. A horizontal shield and a vertical shield are disposed in the housing and shield the contacts from one another.

3 Claims, 17 Drawing Sheets

HIGH SPEED MODULAR JACK INCLUDING MULTIPLE CONTACT BLOCKS AND METHOD FOR ASSEMBLING SAME

This application claims priority to provisional application No. 60/747,534 entitled "HIGH SPEED MODULAR JACK" filed May 17, 2006, the entirety of which is hereby incorporated by reference.

BACKGROUND OF THE INVENTION

The use of modular plugs and jacks for data transmission is known. Basically, in order to establish electrical communication and a data path between a first and second device, the first device may send information in the form of electrical signals out into a cable that terminates in a plug. The second device may include a jack. The plug and jack are designed so as to be easily mechanically mate-able in a male-female configuration. Once the plug and jack are mated, electrical members in the plug and connector engage and are electrically mated so that electrical information signals may travel from the first device to the second device.

This plug and jack design is limited by the physical configuration of the modular plug and jack. As data transmission speeds have increased, electrical performance relating to the transfer of electrical signals from plug to connector, has been affected. Each plug and jack frequently includes multiple pairs of contacts used to communicate information. Cross talk between these pairs (where electrical signals in one pair affect electrical signals in another pair) and interference from sources external to the plug-jack configuration, become more of a factor at higher speeds. In order to carry the higher speed data without signal degradation, the plug and jack design changed to include compensation circuitry such as that used to balanced impedance in transmission lines.

Standards organizations such as the Telecommunication Industry Association and the International Organization for Standardization publish standards regarding performance specifications and equipment configurations for plugs and jacks. Different levels or "categories" have been defined for use in twisted-pair cabling such as where a single insulated sheath includes two twisted wires. For example, "Category 6" plugs and jacks should be able to handle data communications with a frequency up to 250 MHz. Category 6 plugs typically have eight contacts aligned in a row on one side of the plug. More recent requirements, e.g. Category 7, require plugs and jacks which can communicate at speeds as high as 600 MHz.

The balanced line compensation approach discussed above proved acceptable for performance levels up to Category 6 i.e., 250 MHz. In order to meet the electrical requirements of the transmission speeds specified in Category 7, the cross talk and interference generally could not be canceled out using only balanced line compensation and so the contacts were moved to opposite sides of the plug and jack. As the industry is evolving from Category 6 to Category 7 usage, it is desirable to provide a jack that can receive and communicate with plugs using either standard. Providing such a connector is difficult because while eight (8) coplanar contacts had been used in Category 6 applications, in Category 7, the eight contacts are spaced in two different planes on opposite sides of the jack so as to minimize crosstalk between signal pairs.

An example of a prior art jack which may be used for both Category 6 and Category 7 communications is shown in U.S. Pat. No. 6,739,892 and is reproduced in part, in FIG. 1. Referring to FIG. 1, a prior art connector 50 consists of a shield 52, a dielectric housing 54, a switch insert 56 and a circuit board sub-assembly 58. When assembled, sub-assembly 58 is inserted into switch insert 56, switch insert 56 is inserted into housing 54, and housing 54 is inserted into shield 52. When a Category 6 plug is inserted into jack 50, terminals on sub-assembly 58 engage corresponding terminals of the plug for data communication. If a Category 7 plug is inserted into jack 50, a protrusion on the plug engages a switch 60 on switch insert 56. Switch 60 causes some of the terminals in connector 50 to be lifted away from electrical connection and moved into contact with a grounding member (not shown).

There are problems with the prior art connector shown in FIG. 1. Requiring a switch to disengage or ground some of the terminals increases the complexity of the device. Moreover, there is the possibility of an open circuit especially if there is a failure in the switch.

SUMMARY OF THE INVENTION

One embodiment of the invention is a jack comprising at least a first, second, third and fourth contact block, each contact block including at least two contacts and a housing including walls defining four distinct chambers, each chamber effective to receive a respective contact block. The jack further comprises a shield disposed so as to shield the first contact block from the second, third and fourth contact blocks.

Another embodiment of the invention is a method for assembling a jack, the method comprising inserting a first contact block into a first chamber in a housing, the first contact block including at least two contacts and inserting a second contact block into a second chamber in the housing, the second contact block including at least two contacts. The method further comprises inserting a third contact block into a third chamber in the housing, the third contact block including at least two contacts and inserting a fourth contact block into a fourth chamber in the housing, the fourth contact block including at least two contacts; wherein the first, second, third and fourth chambers are distinct. The method further comprises inserting a shield into the housing disposed so as to shield the first contact block from the second, third and fourth contact blocks.

DETAILED DESCRIPTION OF THE PREFERRED EMBODIMENT(S)

Figure 1:
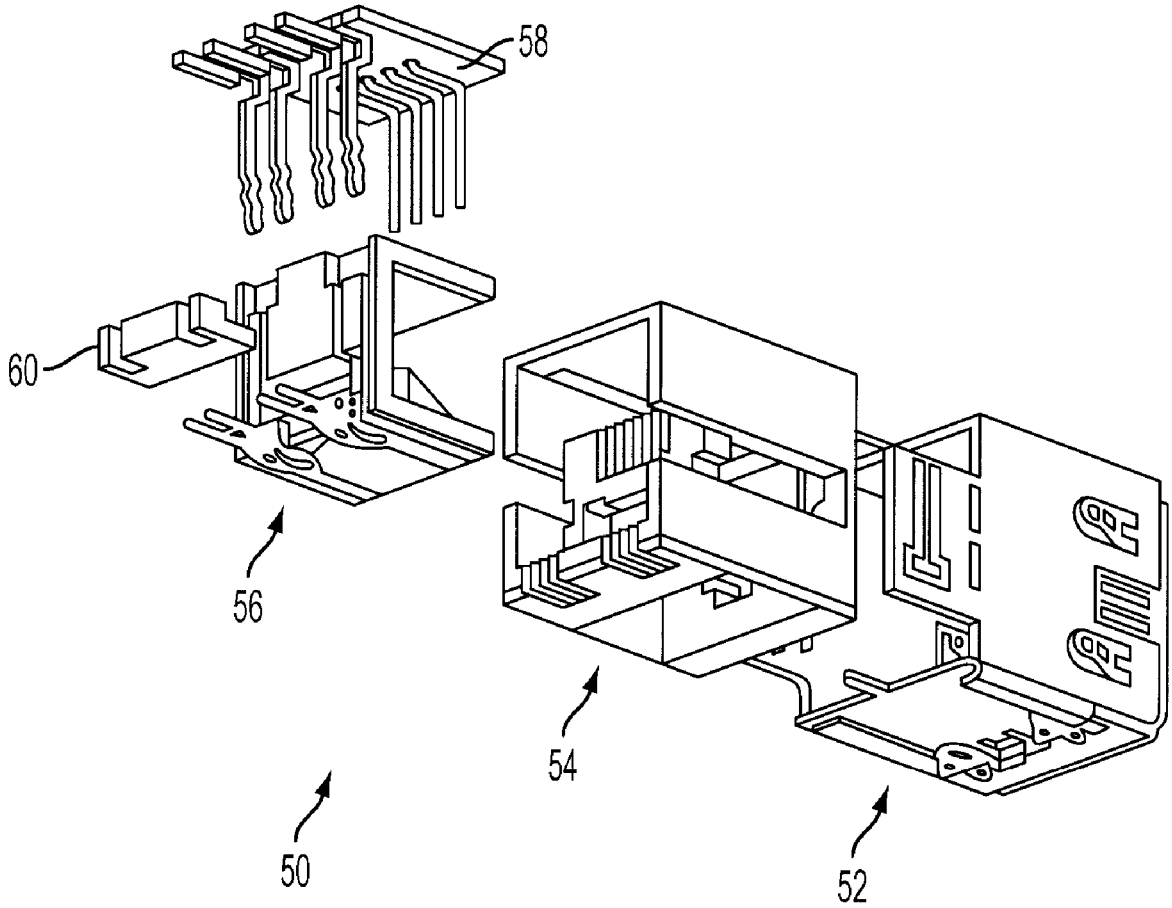
FIG. 1 PRIOR ART
FIG. 1 is a side perspective cut-away view of a jack in accordance with the prior art.
Figure 2:
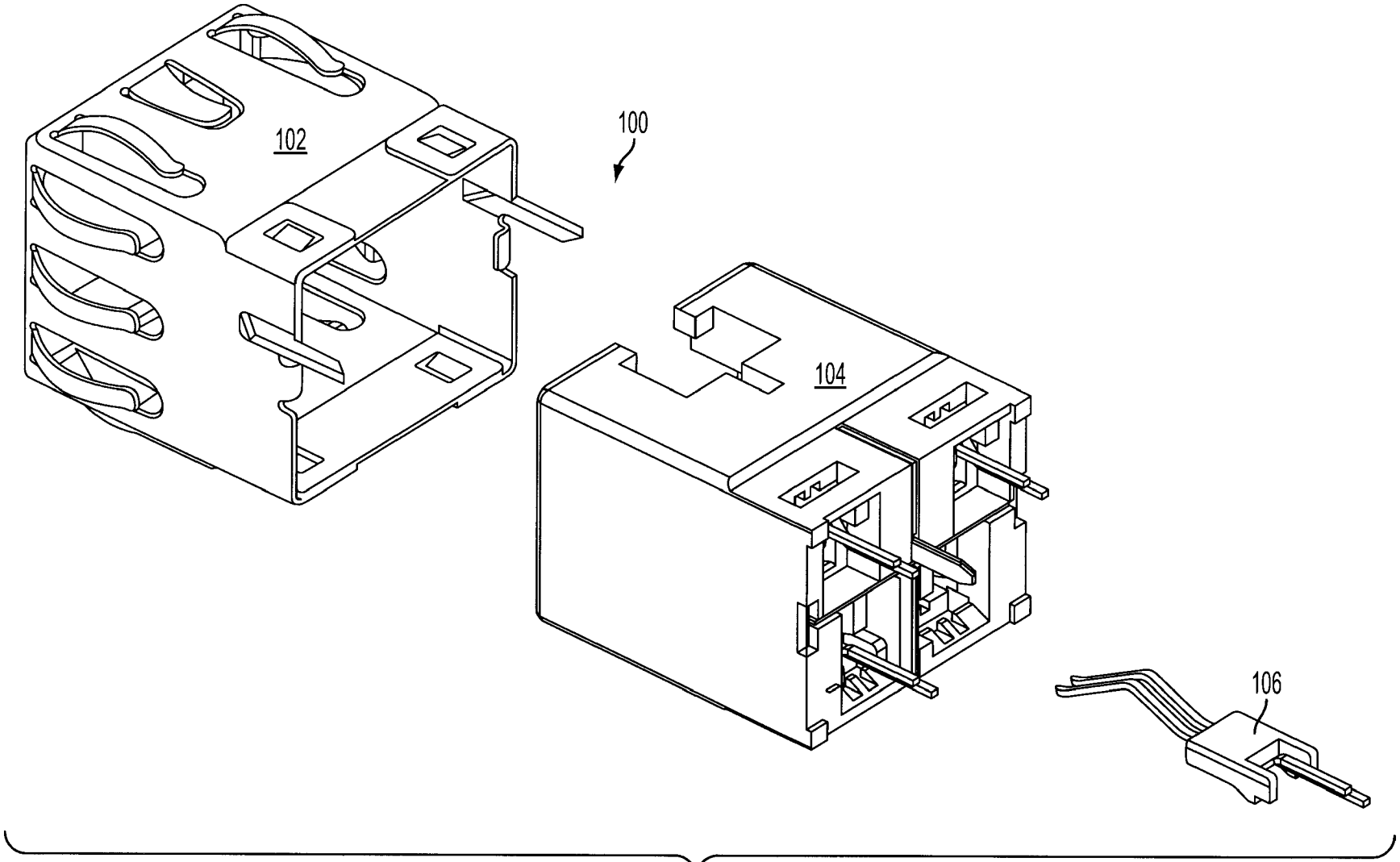
FIG. 2 is a rear perspective exploded view of a jack in accordance with an embodiment of the invention.
Figure 3:
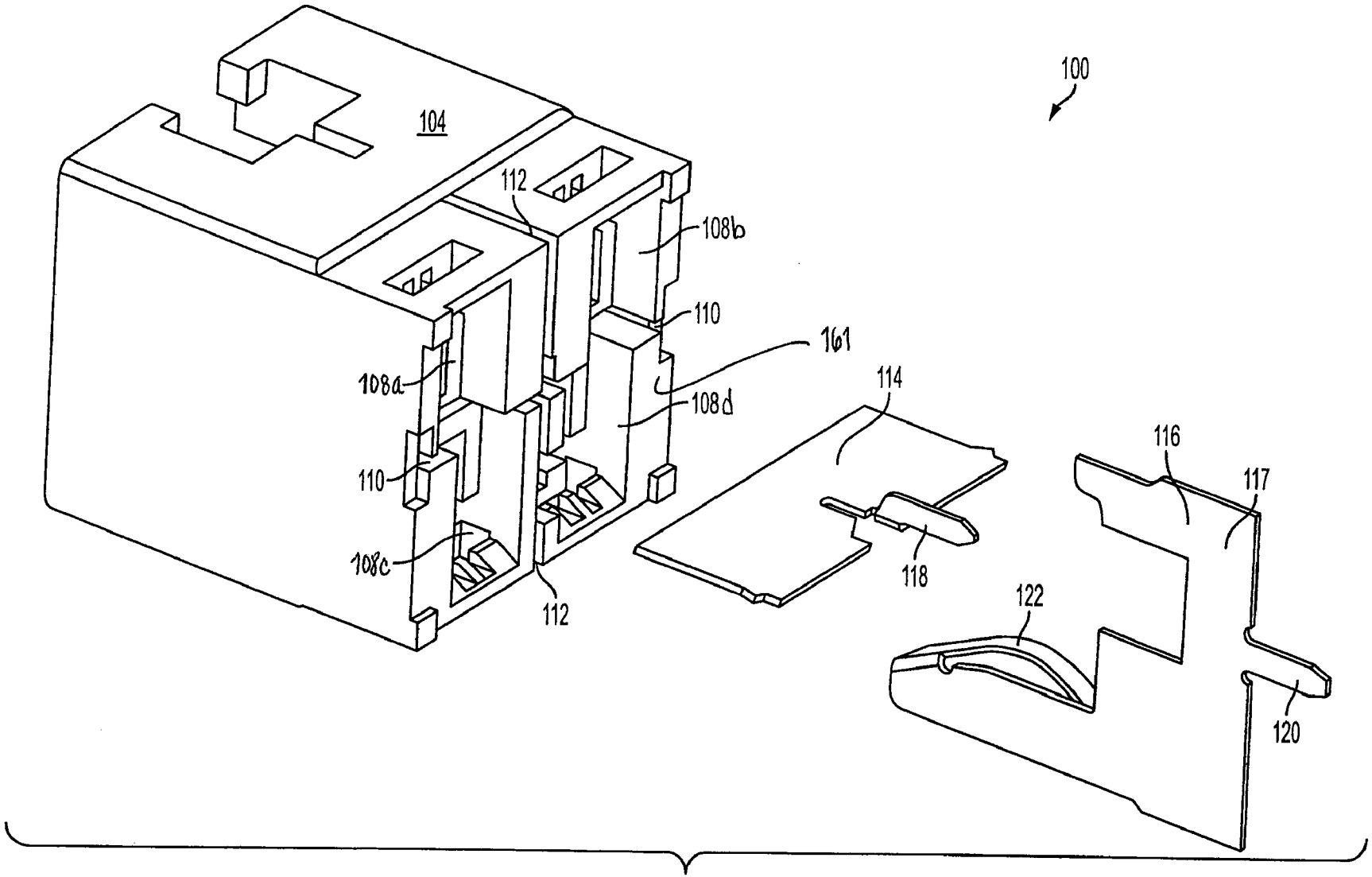
FIG. 3 is a rear perspective exploded view of a jack in accordance with an embodiment of the invention.

Referring to FIG. 2, there is shown a jack 100 in accordance with an embodiment of the invention. Jack 100 includes a shield 102, a housing 104, and four contact blocks 106 in housing 104. Referring to FIG. 3, housing 104 includes walls defining four chambers 108 for receiving contact blocks 106 therein. Slots 110 and 112 are used to receive a horizontal shield 114 and a vertical shield 116. Horizontal shield 114 includes a tab 118 and is effective to shield contacts disposed above horizontal shield 114 from contacts disposed below horizontal shield 114. Vertical shield 116 includes a tab 120 and shields contacts disposed on a left of vertical shield 116 from contacts disposed on a right of shield 116. Vertical shield 116 also includes a ground spring 122 biased upwardly and an extension portion 117. To assemble jack 100, horizontal shield 114 is slid into slot 110 and vertical shield 116 is slid into slot 112 so that they touch and tabs 118, 120 form a single tab as shown in FIG. 4.

Figure 4:
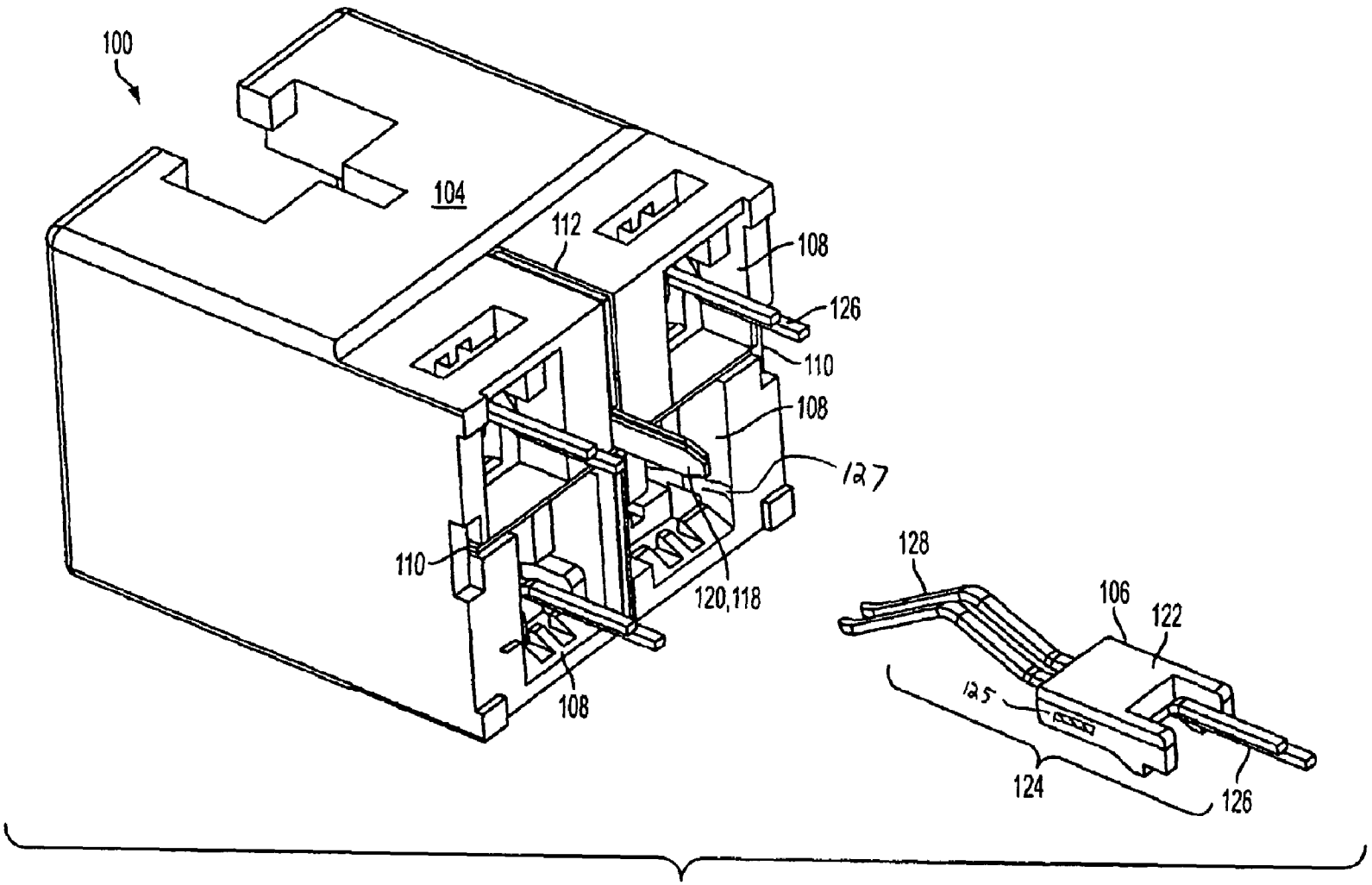
FIG. 4 is a rear perspective exploded view of a jack in accordance with an embodiment of the invention.
Figure 5:
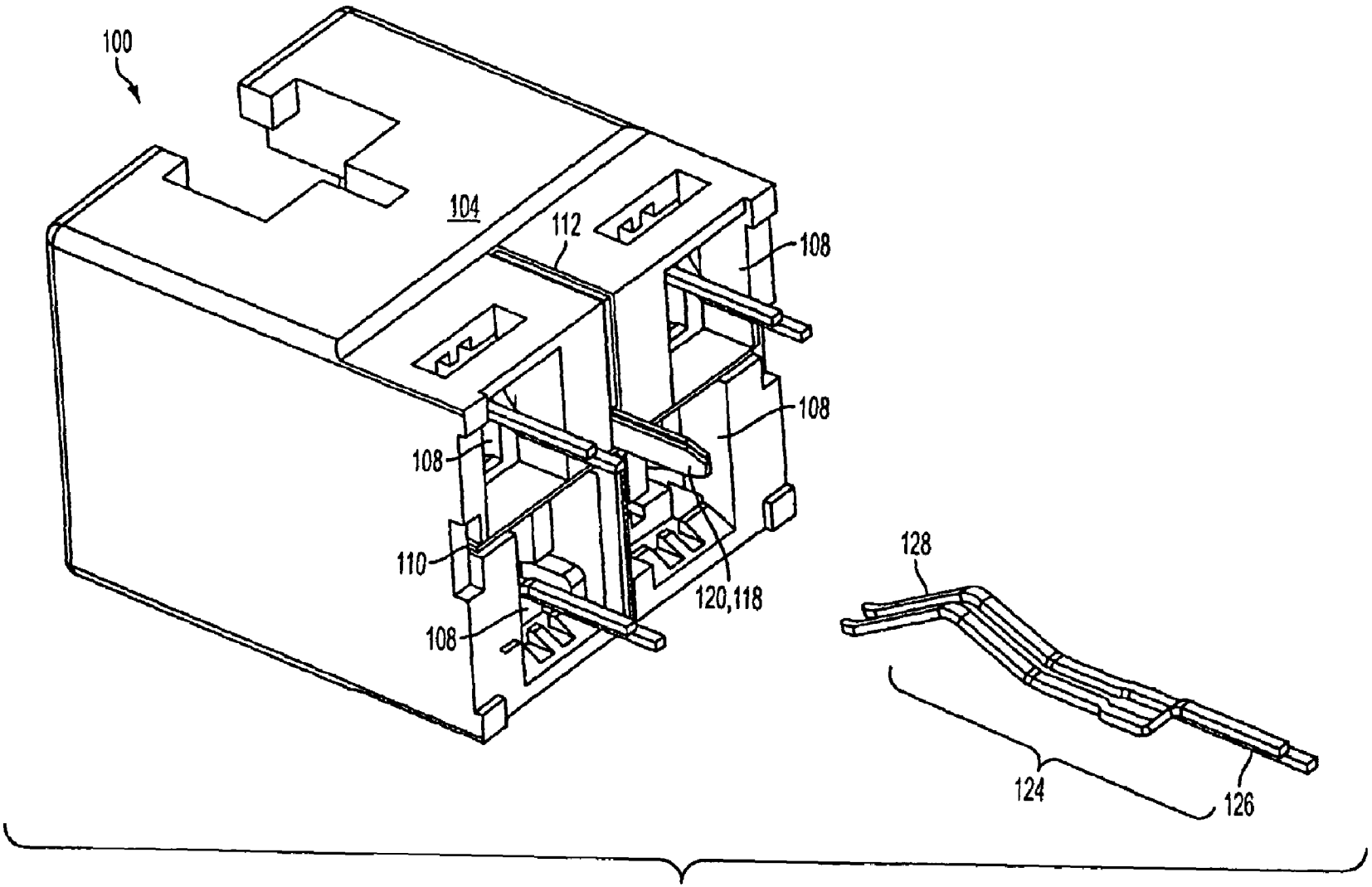
FIG. 5 is a rear perspective exploded view of a jack in accordance with an embodiment of the invention.

With continuing reference to FIG. 4 and with reference to FIG. 5, contact block 106 includes a base plastic member 122 which carries contacts 124 having terminal ends 126 extending in two planes and contact portions 128. Plastic member 122 may be slid into housing 104 such as by tongue and groove communication. For example, a tongue 125 may extend from plastic member 122 and mate with a groove 127 in housing 104.

Figure 6:
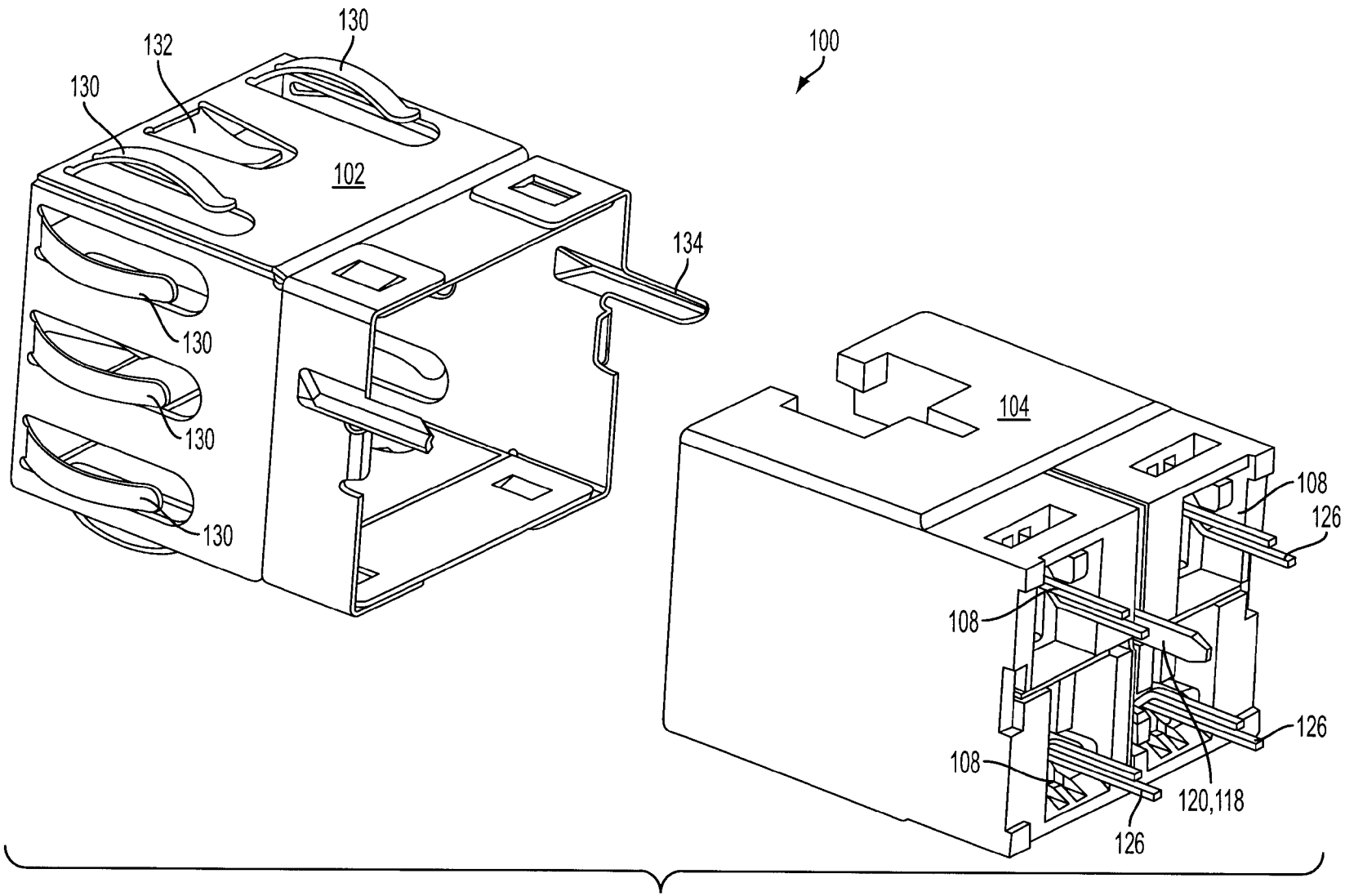
FIG. 6 is a rear perspective exploded view of a jack in accordance with an embodiment of the invention.
Figure 7:
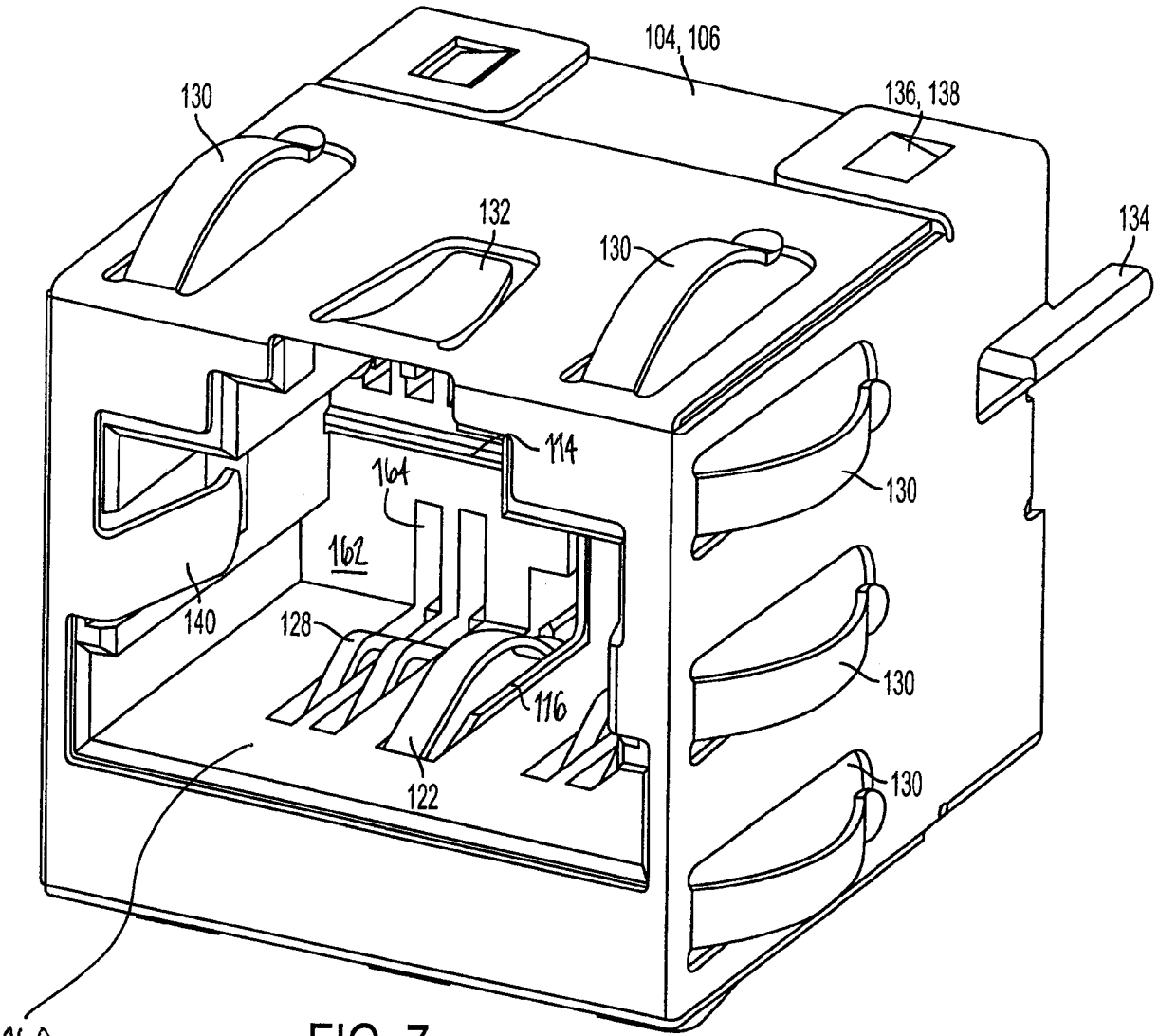
FIG. 7 is a front perspective view of a jack in accordance with an embodiment of the invention.
Figure 8:
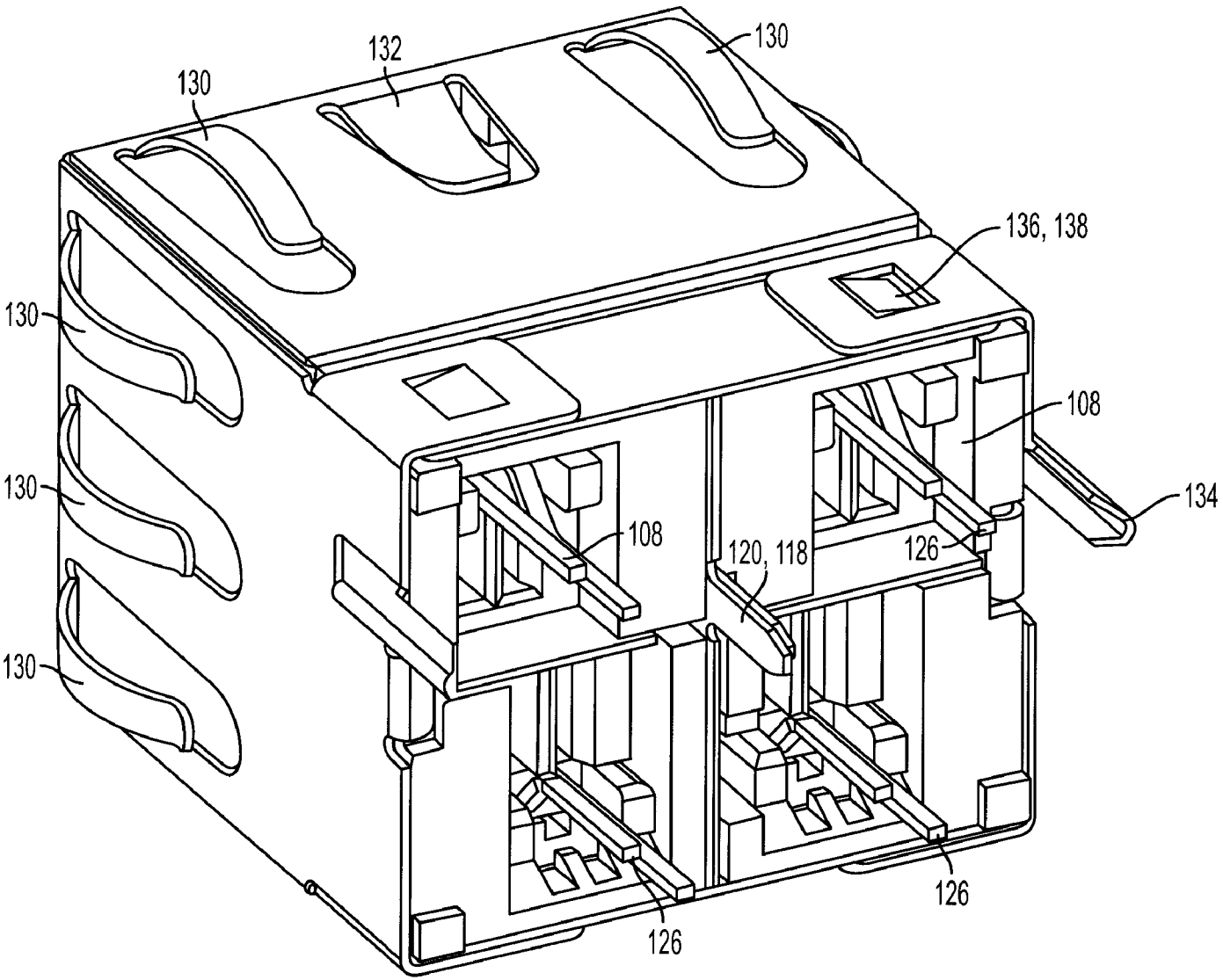
FIG. 8 is a rear perspective view of a jack in accordance with an embodiment of the invention.

Referring to FIG. 6, after contact blocks 106 have been inserted into housing 104, housing 104 may be inserted into shield 102. Referring to FIGS. 7 and 8, shield 102 may include a latch 136 and void 138 to facilitate a closing of shield 102 around housing 104. Shield 102 may include grounding springs 130 biased outwardly from shield 102. Springs 130 may be used to bring shield 102 to a potential of a chassis holding jack 100. Ground terminals 134 may be used to connect shield 102 to a grounding pin on a circuit board mounting jack 100. Ground springs 132 and 140 extend inward from shield 102 and may be used to communicate with a shield of a plug inserted into jack 100. In this way, the shield of the plug may be brought to the same potential as the shield 102. Moreover, when the plug is inserted, extension 117 of shield 116 (FIG. 3) may be, for example, disposed within 2 to 4 mm of the plug shield so as to reduce a potential for resonance. Tabs 118, 120 are at the same potential and may be used to communicate with a ground terminal of a user's circuit board mounting jack 100. In this way, the shield of the plug may be brought to the same potential as shield 102 and shield 116. Further, as four shielded chambers are defined, contacts 124 operate essentially parallel to one another.

In summary, and further describing the construction of the jack 100 shown in FIGS. 2-8, the jack 100 has a housing 104 which defines a forwardly opening plug-receiving receptacle 160 (FIG. 7) bounded at its back end by wall 62 of housing 104 (FIG. 7). The four chambers 108 are situated in housing 104 rearwardly of plug-receiving receptacle 160, open onto a rear surface 161 of the housing (FIG. 5) and communicate with the receptacle, such as through openings 164 (FIG. 7). Referring to (FIG. 5) the four chambers are arranged to include an upper pair laterally adjacent chambers 108*a*, 108*b* a lower pair of laterally adjacent chambers 108*c*, and a left-side pair of vertically adjacent chambers 108*a*, 108*c*, and a right-side pair of vertically adjacent chambers 108*b* and 108*d*. Each of the four contact blocks 106 includes a base member 122 that carries a pair of contacts 124, each contact 124 including a terminal and 126 and a contact portion 128. The base member 122 of each contact block 106 is situated in a respective one of the chambers 108. The contact portion 128 of each contact 124 carried by each base member 122 extends into the plug-receiving receptacle 160 (FIG. 7) and is structured and arranged to be engaged by contacts of a modular plug when the plug is inserted into the plug-receiving receptacle 160. The horizontal shield member 114 is situated in the horizontal slot 110 between the upper and lower pairs of laterally adjacent chambers 108*a*, 108*b* and 108*c*, 108*d* and the vertical shield member 116 is situated in the vertical slot 112 between the left and right side pairs of vertically adjacent chambers 108*a*, 108*c* and 108*b*, 108*d*. As seen in FIG. 7. the shield members 114 and 116 do not extend into the plug-receiving receptacle 160 but terminate prior thereto.

As best seen in FIGS. 7 and 8, contacts 124 are disposed symmetrically about a central axis of housing 104 so that contacts on a bottom of housing 104 are disposed the same distance from a horizontal plane through a center of housing 104 as contacts disposed on a top of housing 104. Similarly, contacts on the bottom of housing 104 are disposed at a distance from a vertical plane through a center of housing 104 that is the same as the distance from the contacts on the top of housing 104 from the vertical plane through the center of housing 104.

Figure 9:
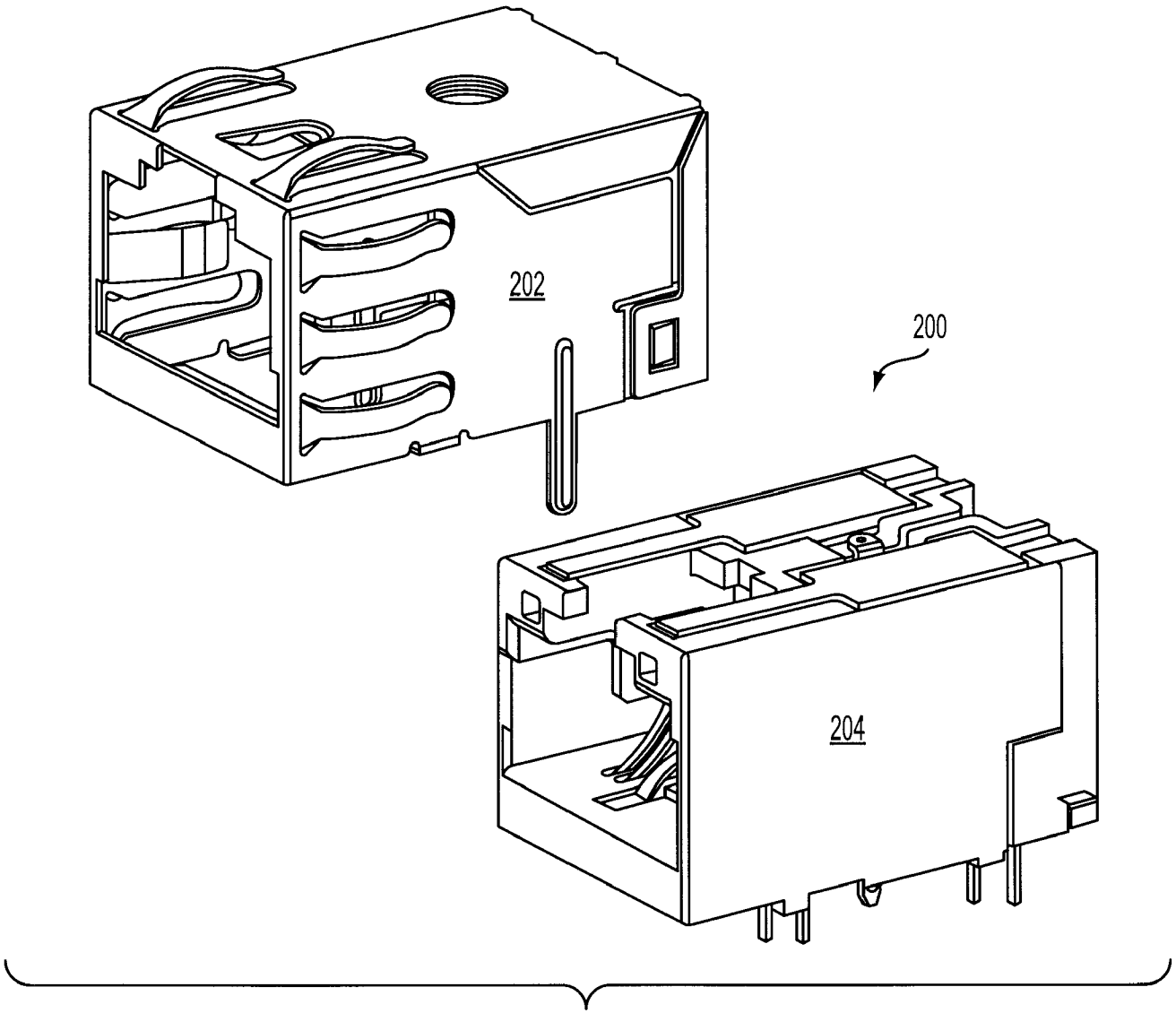
FIG. 9 is a side perspective view of a jack in accordance with an embodiment of the invention.
Figure 10:
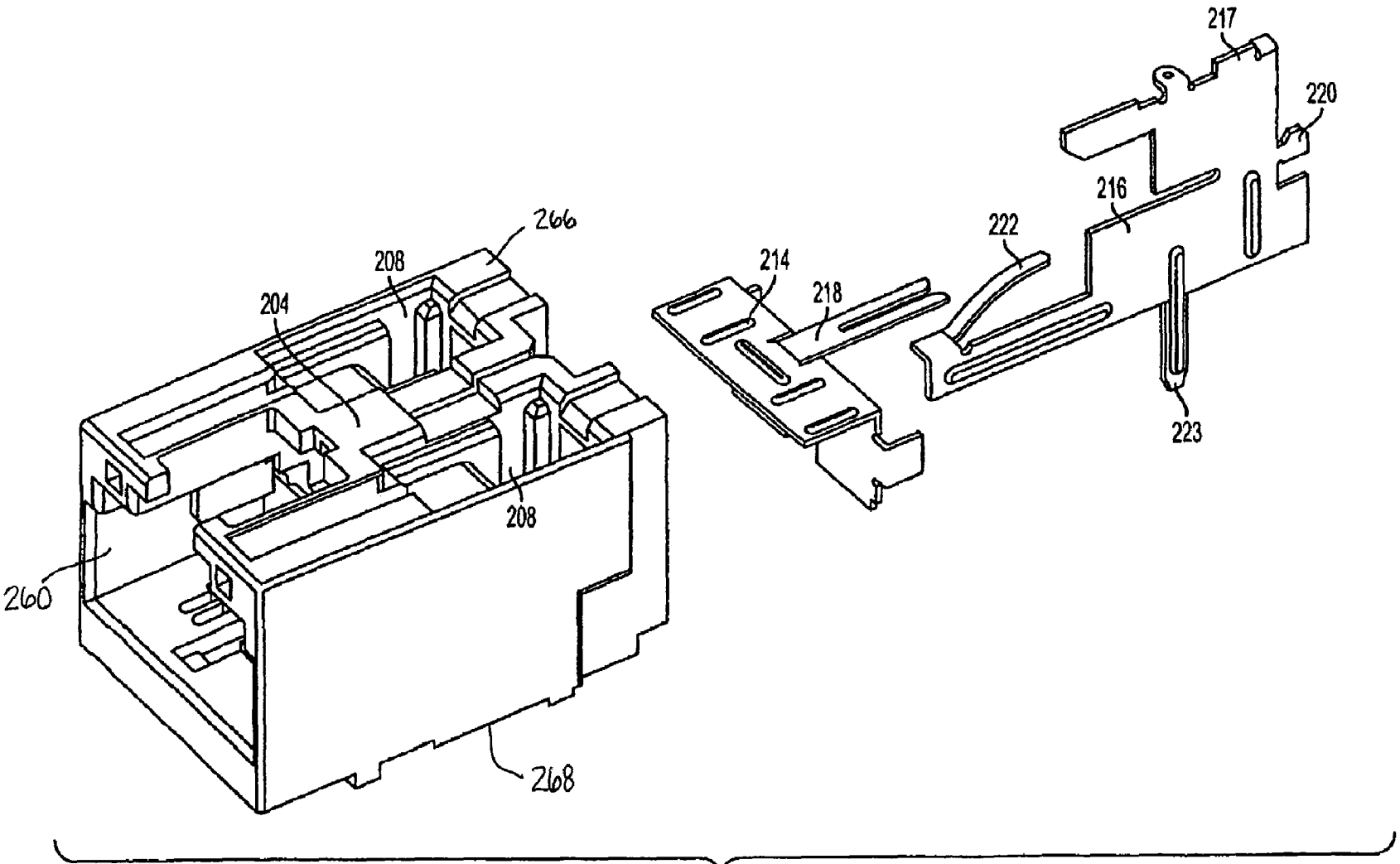
FIG. 10 is a side perspective view of a jack in accordance with an embodiment of the invention.

Referring to FIG. 9, there is shown a jack 200 in accordance with another embodiment of the invention. Jack 200 includes a shield 202 and a housing 204. Referring to FIG. 10 housing 204 includes walls defining two chambers 208 open from a top of housing 204 and two chambers 209 (not explicitly shown) open from a bottom of housing 204 for receiving contact blocks 206 therein—discussed below. Housing 204 further includes slots used to receive a horizontal shield 214 and a vertical shield 216. Horizontal shield 214 includes a tab 218 mate-able with vertical shield 216 and is effective to shield contacts disposed above horizontal shield 214 from contacts disposed below horizontal shield 214. Vertical shield 216 also includes a tab 220 and shields contacts disposed on a left of vertical shield 116 from contacts disposed on a right of shield 116. Vertical shield 216 also includes a ground spring 222 biased upwardly, a ground terminal 223 and an extension 217.

Figure 11:
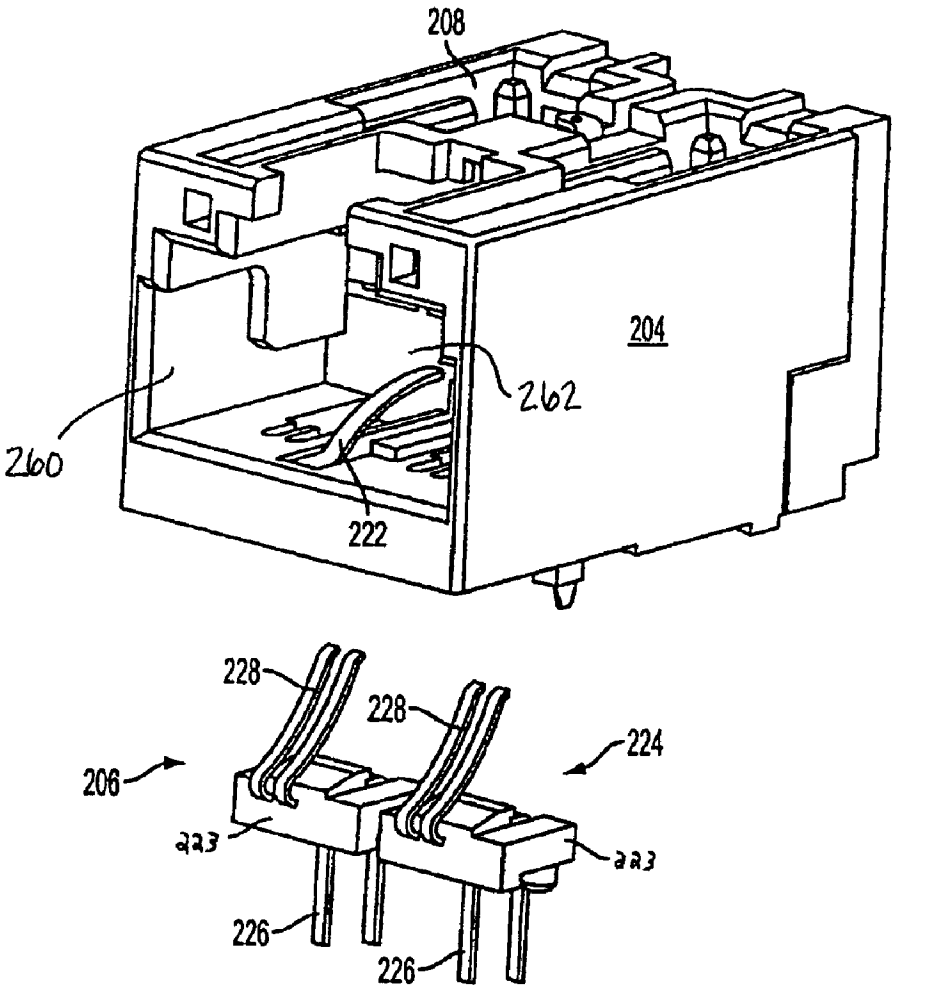
FIG. 11 is a side perspective exploded view of a jack in accordance with an embodiment of the invention.
Figure 12:
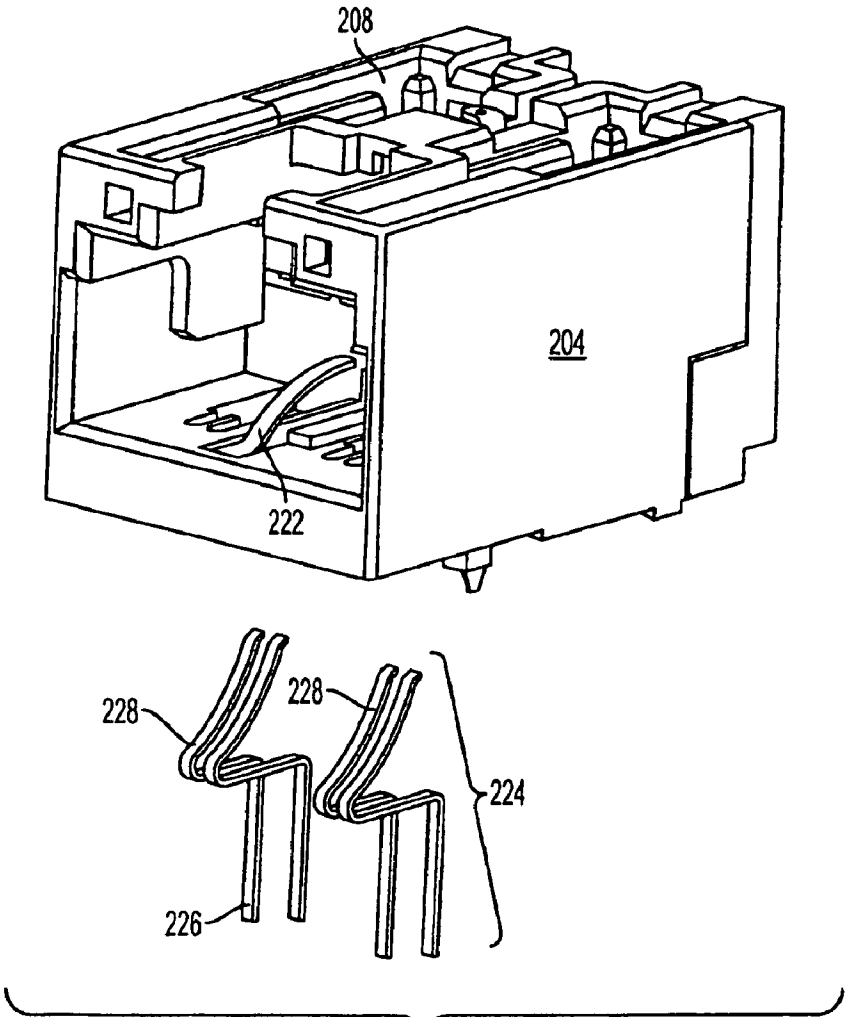
FIG. 12 is a side perspective exploded view of a jack in accordance with an embodiment of the invention.

Referring to FIGS. 11 and 12, lower contact blocks 206 include a base plastic member 223 which carries contacts 224 having terminal ends 226 and contact portions 228. Plastic member 223 may be slid upward into chamber 209 of housing 204 such as by tongue and groove communication. For example, a tongue may extend from plastic member 223 and mate with a groove in housing 204. As shown, contacts 224 of lower contact blocks 206 are rear facing in that ends of contact portions 208 terminate facing a rear of housing 204.

Figure 13:
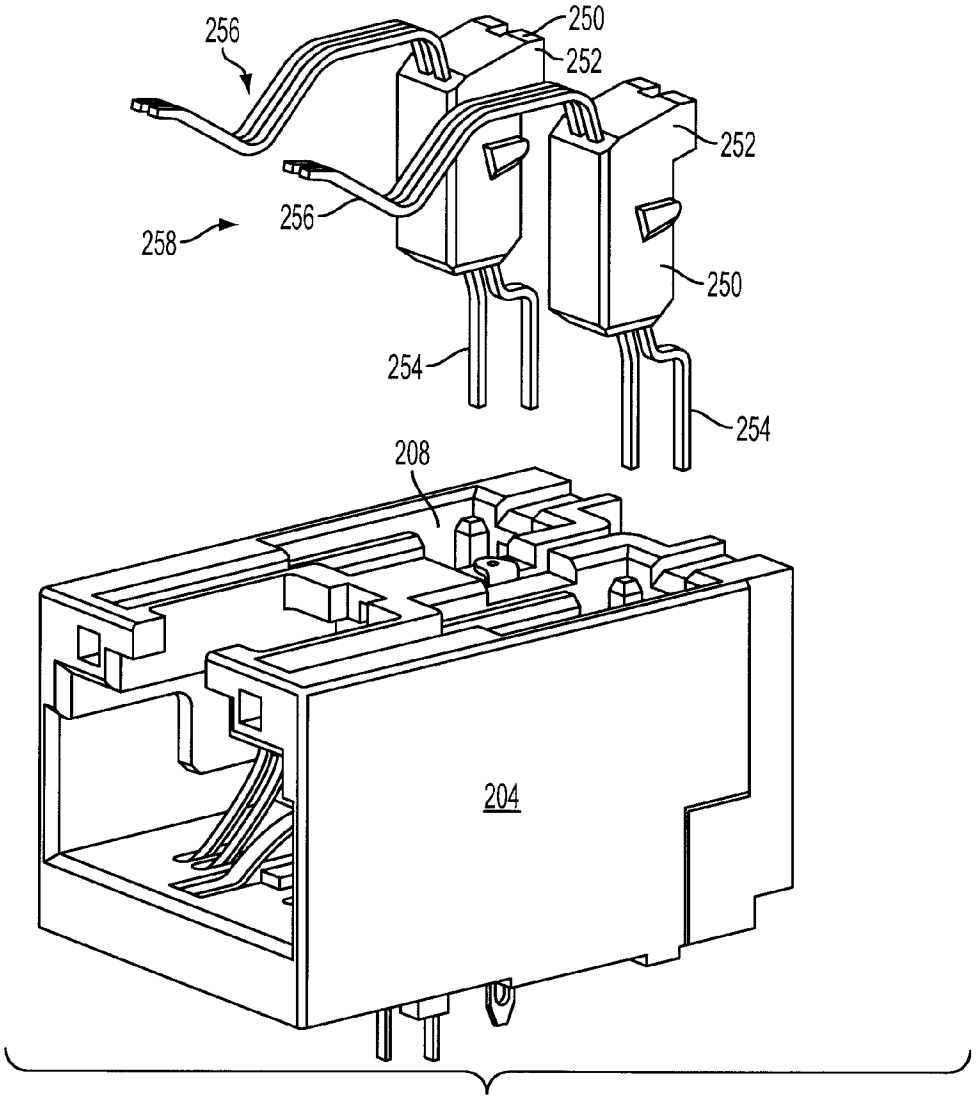
FIG. 13 is a side perspective exploded view of a jack in accordance with an embodiment of the invention.
Figure 14:
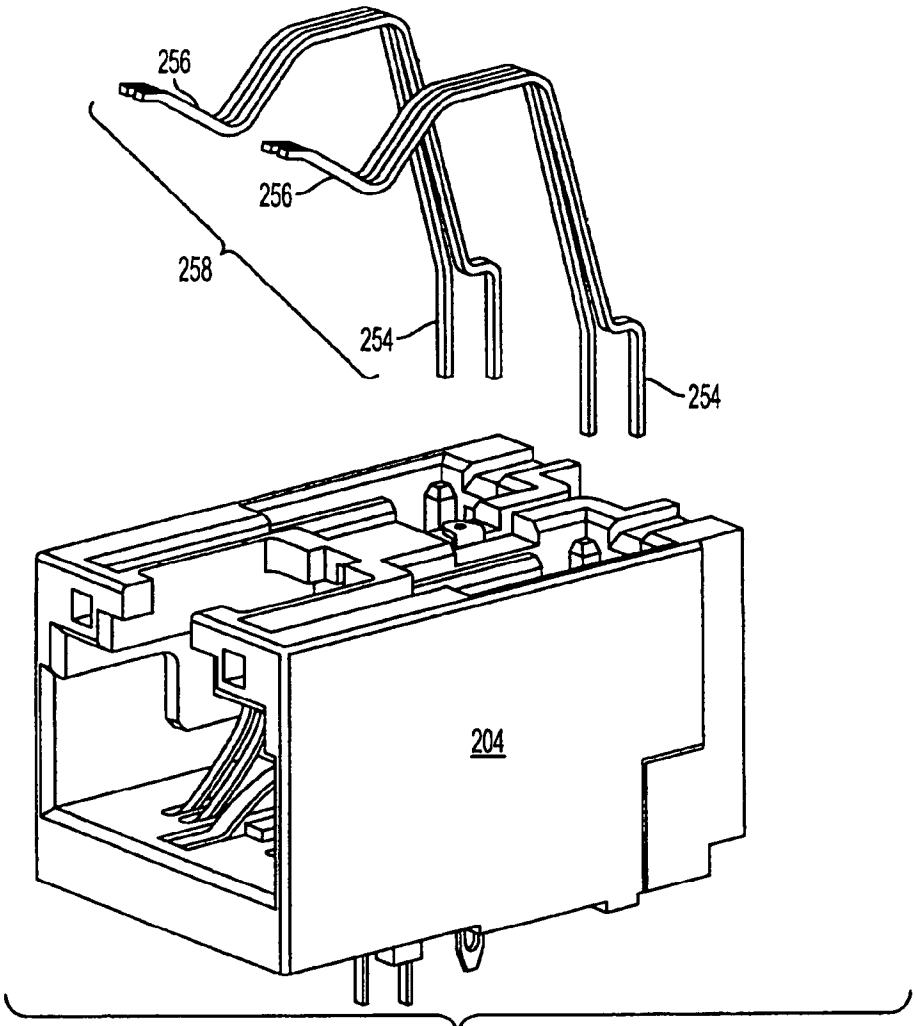
FIG. 14 is a side perspective exploded view of a jack in accordance with an embodiment of the invention.

Referring to FIGS. 13 and 14, upper contact blocks 250 include a base plastic member 252 which carries contacts 258 having terminal ends 254 and contact portions 256. Plastic member 252 may be slid into chamber 208 of housing 204 such as by tongue and groove or circumferential communication. For example, a tongue may extend from plastic member 252 and mate with a groove in housing 204. As shown, contacts 258 of upper contact blocks 250 are forward facing in that ends of contact portions 256 terminate facing a front of housing 204.

In summary, and further describing the construction of jack 200 shown in FIGS. 9-15, the jack 200 has a housing 204 which defines a forwardly opening plug-receiving receptacle 26-(FIG. 11) bounded at its back end by wall 262 (FIG. 11) of housing 204. As best seen in FIG. 10, the four chambers 208, 208, 209 (not shown), 209 (not shown) are situated in housing 204 rearwardly of plug-receiving receptacle 260. The upper chambers 208 open onto an upper surface 266 of housing 204 (FIG. 10) while the lower chambers 209 (not shown) open onto a lower surface 268 of housing 204 (FIG. 10). Like the chambers of the embodiment shown on FIGS. 2-8, the four chambers 208, 208 and 209, 209 are arranged to include an upper pair of laterally adjacent chambers 208, 208, a lower pair of laterally adjacent chambers 209, 209 (not shown), a left-side pair of vertically adjacent chambers 208, 209 and a right-side pair of vertically adjacent chambers 208, 209. Each of the four contact blocks 206 includes a base member 223, 252 that carries a pair of contacts 224, 258, each of which includes a terminal and a contact portion. The base member 223, 352 of each contact block 206 is situated in a respective one of the chambers 208, 208, 209, 209 and the contact portion of each contact 224, 258 extends into the plug-receiving receptacle 260, and is structured and arranged to be engaged by contacts of a modular plug when the plug is inserted into the plug-receiving receptacle 260. The horizontal shield member 214 is situated in a horizontal slot between the upper and lower pairs of laterally adjacent chambers 208, 208 and 209, 209 (not shown) and the vertical shield member 216 is situated in a vertical slot between the left- and right-side pairs of vertically adjacent chambers 208, 209 and 208, 209. As seen in FIG. 11, the shield members 214, 216 do not extend into the plug-receiving receptacle 260 but terminate prior thereto.

Figure 15:
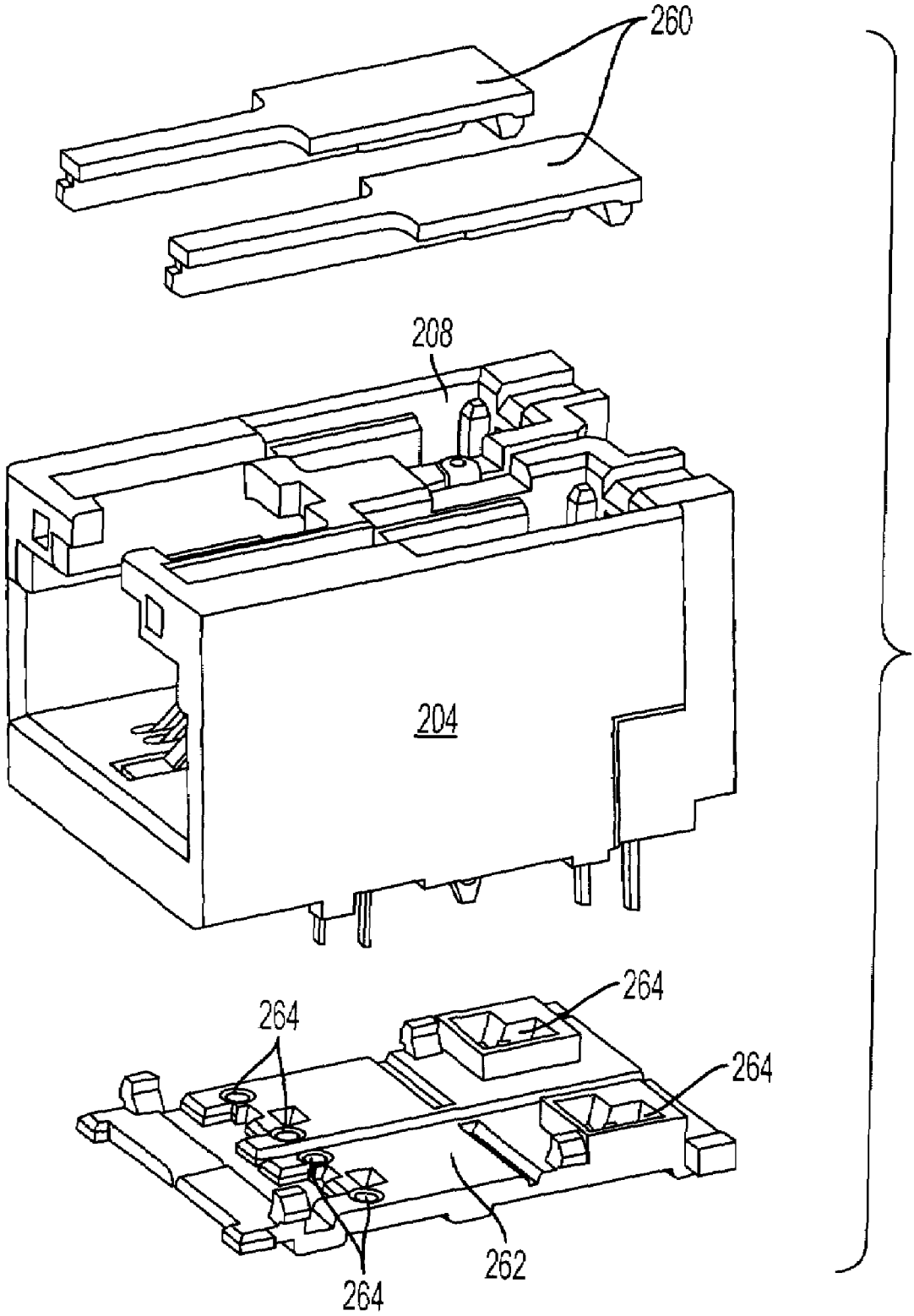
FIG. 15 is a side perspective exploded view of a jack in accordance with an embodiment of the invention.
Figure 16:
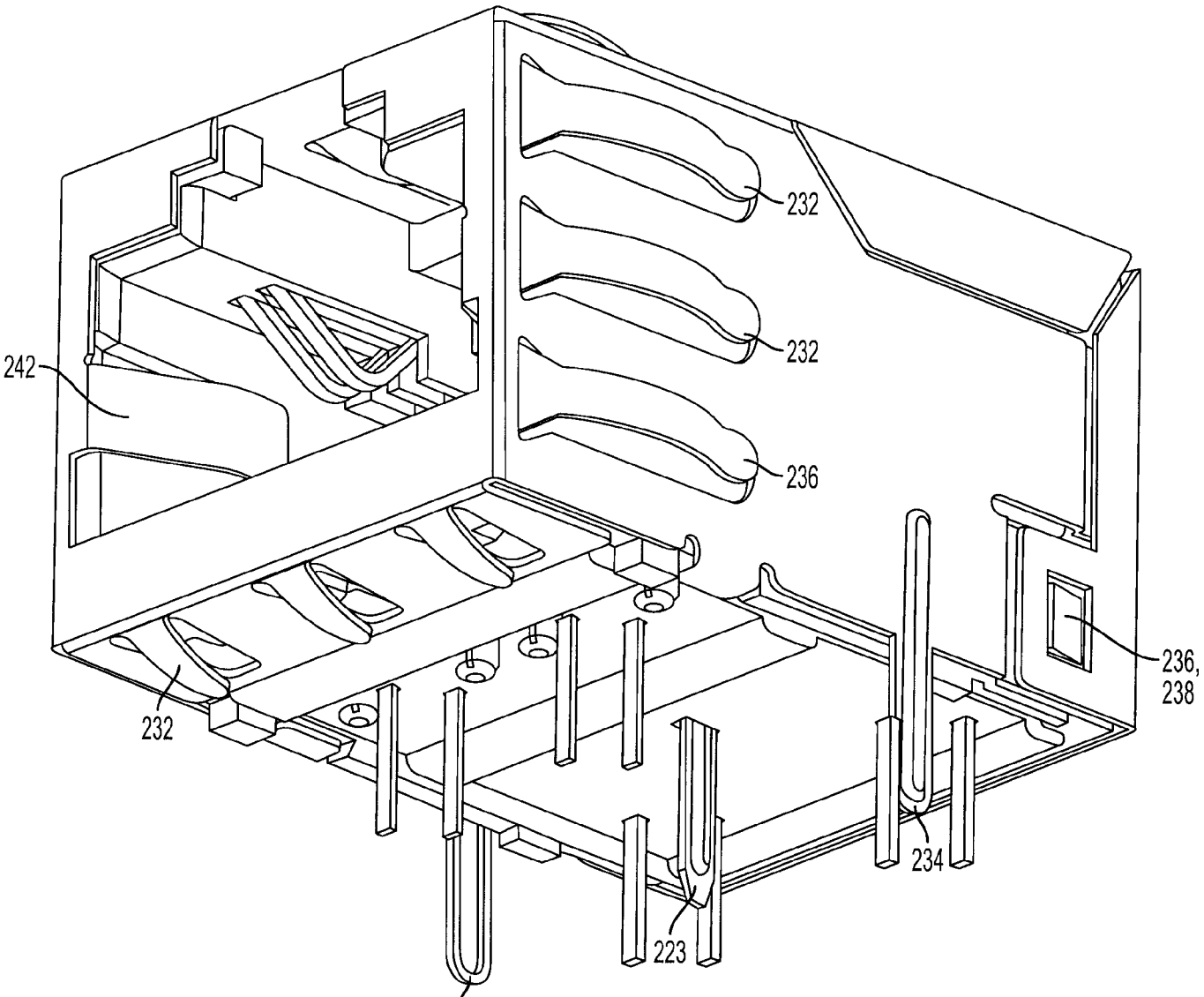
FIG. 16 is a side perspective view of a jack in accordance with an embodiment of the invention.
Figure 17:
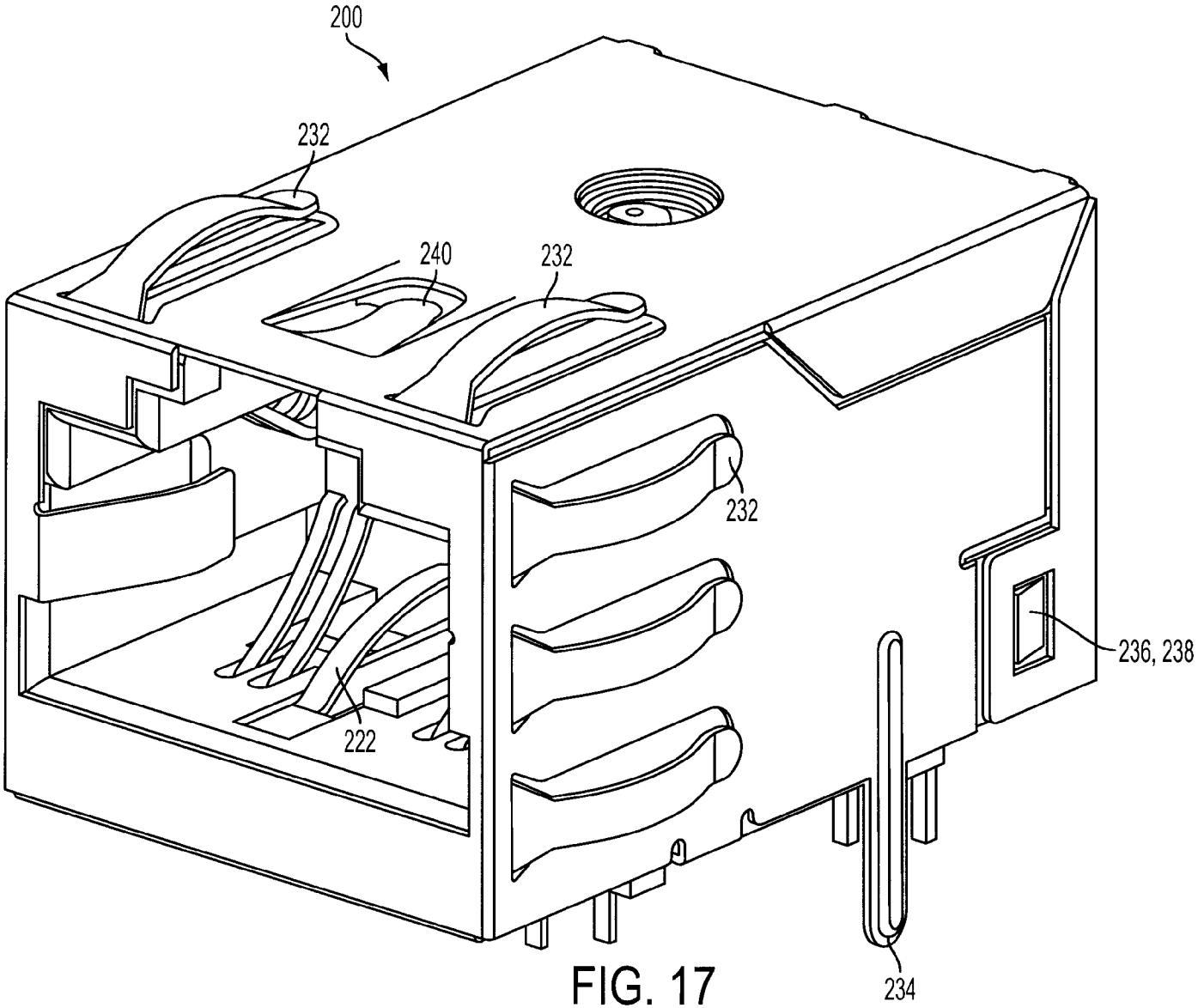
FIG. 17 is a front perspective view of a jack in accordance with an embodiment of the invention.

Referring to FIG. 15, after contacts 224, 258 have been installed into housing 204, top covers 260 and bottom cover 262 may be placed on housing 204. Bottom cover 262 includes openings 264 to allow terminal ends 226, 254 to pass therethrough. Thereafter, as shown in FIGS. 16 and 17, housing 204 may be inserted into shield 202. Shield 202 may include a latch 236 and void 238 to facilitate a closing of shield 202 around housing 204. Shield 202 may include grounding springs 232 biased outwardly from shield 202. Springs 232 may be used to bring shield 202 to a potential of a chassis holding jack 200. Ground terminals 234, along with ground terminal 223 of shield 216 may be used to connect shield 202 to a grounding pin on a circuit board mounting jack 200. Ground springs 242 and 240 extend inward from shield 202 and may be used to communicate with a shield of a plug inserted into jack 100. Moreover, when the plug is inserted, extension portion 217 of shield 216 (FIG. 10) may be, for example, disposed within 2 to 4 mm of the plug shield so as to reduce a potential for resonance. Tabs 218, 220 are at the same potential and may be used to communicate with a ground terminal of a user's circuit board mounting jack 200. In this way, the shield of the plug may be brought to the same potential as the shield 202 and shield 216. Moreover, all contacts exit housing 204 widely separate from one another so as to reduce cross-talk. Further, as four shielded chambers are defined, the conductors operate essentially parallel to one another.

Having described the preferred embodiments of the invention, it should be noted that the scope of the invention is limited only by the scope of the claims attached hereto and obvious modifications may be made without departing from the scope and spirit of the invention.

What is claimed is:

1. A modular jack, comprising a single housing defining a single forward plug-receiving receptacle opening onto a front surface of said housing and four rearward chambers, said four chambers arranged to include an upper pair of laterally adjacent chambers, a lower pair of laterally adjacent chambers, a left-side pair of vertically adjacent chambers and a right-side pair of vertically adjacent chambers, said four chambers situated in said housing rearwardly of said plug-receiving receptacle and communicating therewith;

four contact blocks, each contact blocks including a base member and a pair of contacts carried by said base member, each of such pair of contacts including a contact portion and a terminal end;

said base member of each contact blocks situated in a respective one of said chambers, said contact portion of said pair of contacts carried thereby extending into said plug-receiving receptacle and structured and arranged to be engaged by contacts of a modular plug when the plug is inserted into the plug-receiving receptacle;

a first horizontal slot formed in said housing extending between said upper and lower pairs of laterally adjacent chambers;

a second vertical slot formed in said housing extending between said left-side and right-side pair of vertically adjacent chambers;

a first shield member situated in said first slot extending between said upper and lower pairs of laterally adjacent chambers and terminating prior to said plug-receiving receptacle; and a second shield member situated in said second slot extending between said left-side and right-side pair of vertically adjacent chambers and terminating prior to said plug-receiving receptacle.

2. A modular jack as recited in claim 1 wherein each of said chambers opens onto a rear surface of said housing.

3. A modular jack as recited in claim 1 wherein each of said upper pair of laterally adjacent chambers opens onto a top surface of said housing, and each of said lower pair of laterally adjacent chambers opens onto a bottom surface of said housing.

* * * * *